US008960096B2

(12) United States Patent
Veyrat

(10) Patent No.: US 8,960,096 B2
(45) Date of Patent: Feb. 24, 2015

(54) CHAIR-LIFT STATION HAVING A HIGH FLOW AND SMALL DIMENSIONS

(71) Applicant: Pomagalski, Voreppe (FR)

(72) Inventor: Julien Veyrat, Chignin (FR)

(73) Assignee: Pomagalski, Voreppe (FR)

( * ) Notice: Subject to any disclaimer, the term of this patent is extended or adjusted under 35 U.S.C. 154(b) by 206 days.

(21) Appl. No.: 13/759,489

(22) Filed: Feb. 5, 2013

(65) Prior Publication Data

US 2013/0199401 A1 Aug. 8, 2013

(30) Foreign Application Priority Data

Feb. 6, 2012 (FR) ..... 12 00344

(51) Int. Cl.

| | |
|---|---|
| ***B01B 1/00*** | (2006.01) |
| ***B61B 1/00*** | (2006.01) |
| ***B61B 1/02*** | (2006.01) |
| ***B61B 12/02*** | (2006.01) |

(52) U.S. Cl.

CPC ... *B61B 1/00* (2013.01); *B61B 1/02* (2013.01); *B61B 12/022* (2013.01)

USPC ..... 104/28; 104/173.2; 104/178; 104/173.1

(58) Field of Classification Search

CPC ..... B61B 11/00; B61B 12/022; B61B 1/02; B61B 1/00

USPC ..... 104/173.1, 173.2, 178, 180, 184, 197, 104/27, 28, 30

See application file for complete search history.

(56) References Cited

U.S. PATENT DOCUMENTS

| | | | | |
|---|---|---|---|---|
| 4,050,385 | A | 9/1977 | Gurr et al. | |
| 4,662,285 | A * | 5/1987 | Rossignol | 104/173.2 |
| 4,958,574 | A * | 9/1990 | Meindl | 104/178 |
| 5,570,637 | A * | 11/1996 | Wagner | 104/27 |
| 5,873,310 | A * | 2/1999 | Creissels et al. | 104/173.2 |
| 6,729,241 | B2 * | 5/2004 | Gabriel et al. | 104/173.1 |
| 7,685,947 | B2 * | 3/2010 | Moritzhuber | 104/180 |
| 7,832,339 | B2 * | 11/2010 | Richard | 104/173.1 |
| 2008/0152467 | A1 * | 6/2008 | Moritzhuber | 414/271 |
| 2008/0229966 | A1 * | 9/2008 | Luger | 104/173.1 |

FOREIGN PATENT DOCUMENTS

| | | | |
|---|---|---|---|
| EP | 1 972 520 | A1 | 9/2008 |
| FR | 1393778 | | 2/1965 |
| FR | 2 731 196 | A1 | 9/1996 |
| FR | 2 854 116 | A1 | 10/2004 |
| WO | WO 00/01566 | A1 | 1/2000 |

* cited by examiner

*Primary Examiner* — Mark Le

(74) *Attorney, Agent, or Firm* — Oliff PLC

(57) ABSTRACT

Disengageable chair-lift station having a transfer way made up of a first longitudinal part extending in alignment with the line of the carrying-hauling cable, and of a second transversal part extending perpendicular to the first part. The driving or return pulley is placed between the sections of the first part, and the disembarkation and embarkation platforms are shifted from one another in the second part, so that the disembarkation and embarkation of the skiers are performed on the same side of the station, in a direction perpendicular to the longitudinal axis of the line.

2 Claims, 2 Drawing Sheets

CHAIR-LIFT STATION HAVING A HIGH FLOW AND SMALL DIMENSIONS

TECHNICAL FIELD OF THE INVENTION

The invention relates to an embarkation and disembarkation station for a transport chair-lift using a continuously moving overhead cable and having disengageable seats, comprising:

a transfer way formed by a suspension rail for driving seats disconnected from the carrying-hauling cable, said way being made up of a first longitudinal part extending along the axis of the line, and a second transversal part connected with the first part at right angles, disembarkation and embarkation platforms located in the second part, and a driving or return pulley for the loop rolling of the carrying-hauling cable of the line, said pulley being located at the other end of the line at the level of the first part of the transfer way.

STATE OF THE ART

An embarkation station for a disengageable chair-lift generally comprises, at the entry of the station, a zone for disengaging the seats from the overhead carrying-hauling cable, and for decelerating these seats, which roll then on a transfer rail in order to be moved towards the exit of the station, where they are accelerated again in an acceleration zone, before being coupled again with the opposite strand of the carrying-hauling cable. The overhead carrying-hauling cable is transferred onto a driving pulley continuously rotated by a geared motor. The seats are distributed along the cable at regular intervals, and attached thereto by means of disengageable grips. The trajectory of the seats corresponds to that of the continuously moving cable according to a closed loop. The actuation and deceleration of the seats disconnected from the cable on the transfer rail are performed by any appropriate actuating means, in particular lug chains for driving the grips, or trains of pneumatic tired rollers.

At the embarkation station, the transfer rail is subdivided in a traditional way into an arrival section connected to a departure section by means of an intermediate section. The two arrival and departure sections are substantially parallel to one another, and are connected to the 180°-curved intermediate section. The two bends are located at the same level, and have the same radius of curvature. The embarkation site is generally provided at the end of the intermediate section, enabling skiers to sit down on seats, which are then accelerated again in an acceleration zone, before being coupled again with the overhead carrying-hauling cable by means of the fastening grips. A mobile embarkation carpet facilitates the transport of the skiers provided with their skis towards the embarkation site. The operation of such a chair-lift is traditional and is described for example in document FR 1393778.

Document WO 00/01566 refers to an embarkation station of a chair-lift comprising a bypassing way made up of a rectilinear transfer ramp, connected to an arrival ramp and a departure ramp by means of two upstream and downstream bends, which are arranged at different levels. The upstream bend forms an acute angle between 35° and 55°, and the downstream bend forms an obtuse angle between 125° and 145°. The oblique rectilinear transfer ramp separates the two upstream and downstream bends. The presence of the downstream bend is disadvantageous regarding the embarkation flexibility for the skiers at the embarkation site. To overcome this disadvantage, the installation comprises a specific swiveling mechanism for swiveling the seats in the rectilinear ramp by an angle between 20° and 40°, so as to orientate the frontal face of each seat towards the interior of the acute-angled bend. This swiveling mechanism complicates the achievement of the device for driving the seats on the bypassing way, and increases the production cost of the installation.

Document FR 2854116 relates to an embarkation station having a 180°-curved intermediate section, comprising a first outline and a second outline of different curvatures. The two outlines are substantially located at the same level and have right angles corresponding to quarter-circle trajectories in which the radius of curvature of the second bend is higher than that of the first bend. The center of the second radius of curvature is located, with that of the first radius of curvature, inside the 180°-return loop.

In these known installations, the station requires a great longitudinal dimension, because the transfer way entirely extends in alignment with the line. The disembarkation and embarkation are performed on both sides of the transfer way in directions substantially parallel to the longitudinal direction of the arrival and departure lines. Such station configurations are not always adapted to all the types of environments.

Documents FR 2731196 and U.S. Pat. No. 4,050,385 describe cable transport systems including in the station several embarkation zones requiring several transfer ways towards which vehicles are alternatively orientated. The ways are shifted laterally with respect to the longitudinal direction of the cable line. Such a duplication of the transfer ways increases the lateral dimension of the station.

OBJECT OF THE INVENTION

The object of the invention consists in carrying out a compact chair-lift station, enabling to have a high skier flow and an easy access.

The station according to the invention comprises a transfer way characterized in that:

the rail of the first longitudinal part comprises two parallel sections of different lengths, and connected to two other sections of different lengths in the second transversal part, so as to form a double L connected by a loop arranged between the disembarkation platform and the embarkation platform, the disembarkation and embarkation platforms are shifted from one another in the loop by an interval separating the two sections in the second part, so that the disembarkation and embarkation of the skiers are performed in said interval on the same side of the station, and in a direction perpendicular to the longitudinal axis of the line.

According to a feature of the invention, a seat-house for storing the seats is placed adjacent to the transfer way in a zone opposite the disembarkation and embarkation platforms, a switching being provided at the junction of the longest sections in the first part and the second part of said way.

BRIEF DESCRIPTION OF THE DRAWINGS

Other advantages and features will more clearly arise from the following description of an embodiment of the invention given as a nonrestrictive example and represented in the annexed drawings, in which.

DETAILED DESCRIPTION OF THE INVENTION

Figure 1:
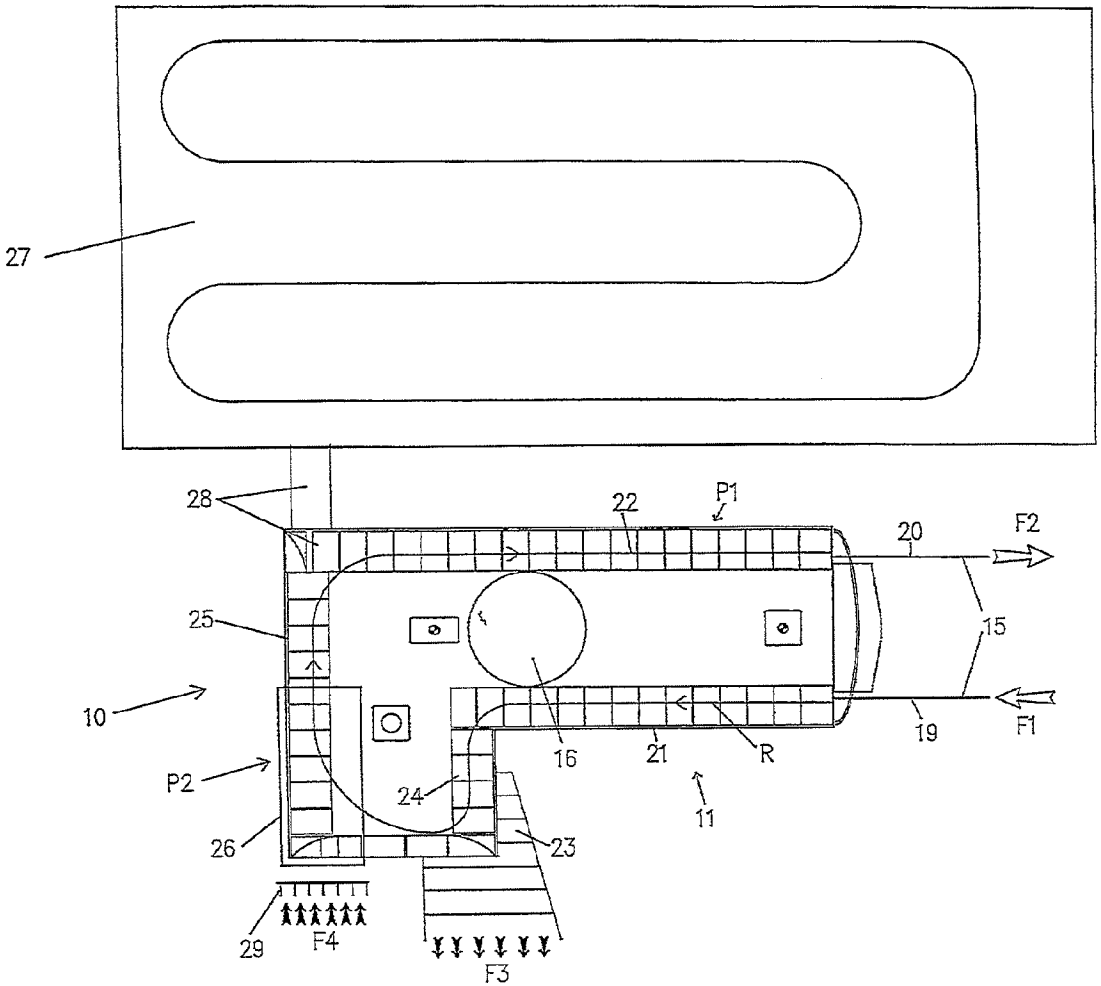
FIG. 1 is a schematic plan view of the embarkation and disembarkation station according to the invention.
Figure 2:
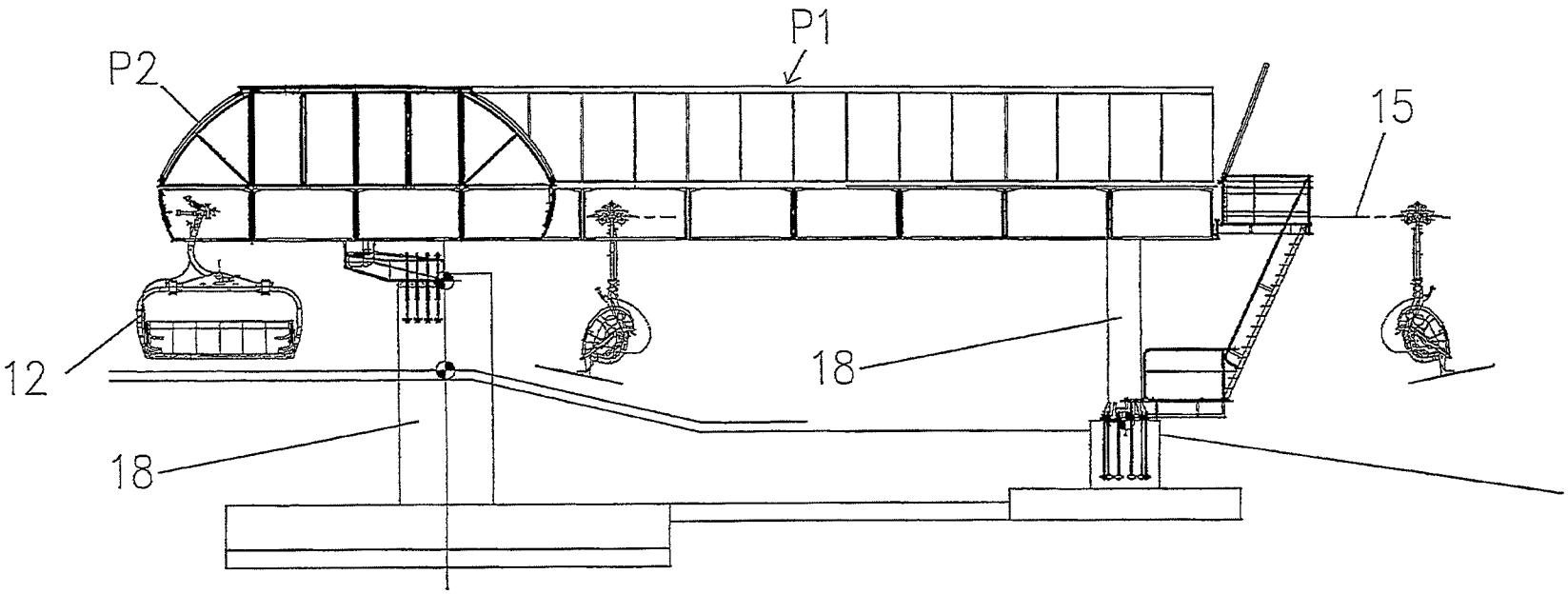
FIG. 2 shows an elevation view of the station in FIG. 1.

In the Figures, a disengageable chair-lift station 10 comprises a transfer way 11 for ensuring the circulation of seats 12 along the embarkation and disembarkation platforms 13, 14. The seats 12 are supported by suspending rods provided with disengageable fastening grips able to be coupled with a carrying-hauling cable 15 outside the station 10, and able to be disconnected from said cable 15 at the entry of the station 10. The carrying-hauling cable 15 is of the continuously moving type and is rolled up on the driving or return pulley 16 located in the station 10.

The seats 12 are driven on the transfer way 11 by means of a series of pneumatic tired wheels, which are distributed along the way, each wheel being rotatingly mounted on a horizontal axis extending perpendicular to the transfer way 11. The wheels can be driven at variable speeds for ensuring the flow rate of the seats 12, the driving movement for the wheels being generally operated by means of an electric motor (not represented), and is transmitted from one wheel to another by a pulley and belt transmission. Other driving systems are of course possible.

The station 10 is placed above the ground, and is supported by brackets 18 fixed to the base in concrete slabs. The transfer way 11 is formed by a suspension rail R for the seats 12, said rail being located in a horizontal plane, and having a specific profile for the adaptation to the L-shaped architecture of the station 10. A footbridge is accessible by means of a staircase 17 provided near one of the brackets 18.

The transfer way 11 is made up of a first longitudinal part P1 substantially arranged in alignment with the arrival line 19 of the cable 15 in the installation and the departure line 20, and of a second transversal part P2 perpendicularly connected to the first part P1. The arrows F1 and F2 indicate the direction of the loop movement of the cable 15.

The pulley 16 is located in the first part P1 at the interval between two rectilinear and parallel sections 21, 22 respectively aligned with the arrival and departure lines 19, 20. The section 21 is shorter than the opposite section 22, and is used for receiving the seats 12 disconnected from the arrival line 19, and to direct them towards the disembarkation platform 23 located in the second transversal part P2.

This second part P2 of the transfer way 11 also comprises two parallel sections 24, 25 of different lengths, respectively connecting the ends of the other sections 21, 22 by forming a right angle. The shortest section 24 is connected to the section 21, and the other section 25 is connected to the section 22.

The disembarkation platform 23 is arranged along the section 24, and the embarkation platform 26 is located at the beginning of the section 25. The rail R follows the various sections 21, 24, 25 and 22 by making a double L connected by a loop, which is arranged between the disembarkation platform 23 and the embarkation platform 26. The two platforms 23, 26 are thus located on the same side of the station, but are shifted from one another by the interval separating the two sections 24, 25.

In addition, beside the transfer way 11 is located a seat-house 27 for storing the seats when the installation is stopped. For that purpose, a switching 28 is provided between the sections 25, 22 for directing the seats 12 towards the seat-house 27.

The operation of the installation allows a high skier flow thanks to the transfer way 11 enabling a disembarkation and embarkation in a direction perpendicular to the arrival and departure lines. When a seat arrives into the station 10 in the direction to the arrow F1, the seat disconnected from the cable 15 is transferred to the longitudinal section 21, then deviated at right angles towards the transversal section 24 in the second part P2, where the skiers leave their seats (arrows F3) at the disembarkation platform 23. The gate 29 opens and enables other skiers to reach the embarkation platform 26 (arrows F4) in order to be embarked on the empty seats in the transversal section 25. The seats with their skiers thereon are then deviated at right angles towards the longitudinal section 22 in the first part P1, then coupled with the departure line 20 (arrow F2).

Such an outline of the transfer way 11 makes it possible to obtain to a high skier flow both in the rising and descending directions, without increasing the longitudinal dimension of the station 10, which remains compact. The disembarkation and embarkation of the skiers are performed on the same side of the station 10.

It is clear that the seats 12 can be replaced with other disengageable transport vehicles, in particular cars or telpher carriers, while remaining in the framework of the invention.

The invention claimed is:

1. Embarkation and disembarkation station for a transport chair-lift using a continuously moving overhead carrying-hauling cable and having disengageable seats, comprising:

a transfer way formed by a suspension rail for driving seats disconnected from the carrying-hauling cable, said way being made up of a first longitudinal part extending along the axis of a line, and a second transversal part connected to the first part at right angles, disembarkation and embarkation platforms located in the second part;

and a driving or return pulley for loop rolling of the carrying-hauling cable of the line, said pulley being located at an end of the line at a level of the first part of the transfer way, wherein the rail of the first longitudinal part comprises two parallel sections of different lengths, and connected to two other sections of different lengths in the second transversal part, so as to form a double L connected by a loop arranged between the disembarkation platform and the embarkation platform, the disembarkation and embarkation platforms are shifted from one another in the loop by an interval separating the two sections in the second part, so that disembarkation and embarkation of skiers are performed in said interval on the same side of the station, in a direction perpendicular to the axis of the line.

2. Embarkation and disembarkation station according to claim 1, wherein a seat-house for storing the seats is placed adjacent to the transfer way in a zone opposite the disembarkation and embarkation platforms, a switching being provided at a junction of the longest sections of the first part and the second part.

* * * * *